US006233961B1

(12) United States Patent
Ashida et al.

(10) Patent No.: US 6,233,961 B1
(45) Date of Patent: May 22, 2001

(54) REFRIGERATOR AND METHOD OF FILLING IT WITH COOLANT

(75) Inventors: Toshio Ashida; Shinichi Nakaishi; Ikuji Ishii; Nobutaka Sasaki; Shin Furuta, all of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/341,133

(22) PCT Filed: Nov. 19, 1998

(86) PCT No.: PCT/JP98/05197

§ 371 Date: Jul. 14, 1999

§ 102(e) Date: Jul. 14, 1999

(87) PCT Pub. No.: WO99/27314

PCT Pub. Date: Jun. 3, 1999

(30) Foreign Application Priority Data

Nov. 21, 1997 (JP) ..... 9-320711

(51) Int. Cl.[7] ..... F25B 45/00
(52) U.S. Cl. ..... 62/292; 62/77
(58) Field of Search ..... 62/77, 149, 292

(56) References Cited

U.S. PATENT DOCUMENTS

| | | | | |
|---|---|---|---|---|
| 1,815,962 | | 7/1931 | Andrews . | |
| 4,230,470 | | 10/1980 | Matsuda et al. . | |
| 4,262,492 | | 4/1981 | Morita et al. . | |
| 4,484,452 | * | 11/1984 | Houser, Jr. | 62/174 |
| 4,796,436 | * | 1/1989 | Voorhis et al. | 62/77 |
| 5,186,012 | * | 2/1993 | Czachorski et al. | 62/114 |
| 5,187,942 | * | 2/1993 | Komatsu et al. | 62/149 |
| 5,381,669 | * | 1/1995 | Bahel et al. | 62/129 |

FOREIGN PATENT DOCUMENTS

| | | |
|---|---|---|
| 0 730 128 A1 | 9/1996 | (EP) . |
| 09236360 | 9/1997 | (EP) . |
| 4-55670 | 2/1992 | (JP) . |
| 4-151475 | 5/1992 | (JP) . |
| 5-99540 | 4/1993 | (JP) . |
| 8-210736 | 8/1996 | (JP) . |
| 10-281597 | 10/1998 | (JP) . |
| WO 95/21359 | 8/1995 | (WO) . |

OTHER PUBLICATIONS

Edited by Japan Society of Refrigerating and Air Conditioning Engineering, Shinban, Dai–4–Han, Reito–Kucho Binran (Kiso–Hen), pp. 704–705, Published May 30, 1981.

* cited by examiner

*Primary Examiner*—Corrine McDermott
*Assistant Examiner*—Melvin Jones
(74) *Attorney, Agent, or Firm*—Nixon Peabody, LLP; Donald R. Studebaker

(57) ABSTRACT

In a main circuit (12) of refrigerant circuitry (11), a liquid-side shutoff valve (23) is provided between a liquid receiver (19) and an indoor heat exchanger (20). Downstream of the liquid-side shutoff valve (23), a refrigerant charging section (40A) including a refrigerant charge valve (40) connectable with a refrigerant cylinder (31) is provided. The refrigerant circuitry (11) includes a pressure relieving circuit (SVP) for conducting refrigerant in a high-pressure-side line of the refrigerant circuitry (11) to a low-pressure-side line thereof in additional refrigerant charging operation executed by operating compressors (15, 22) with the liquid-side shutoff valve (23) closed. The refrigerant circuitry (11) further includes an injection circuit (SVT) for lowering the temperature of refrigerant discharged from the compressors (15, 22) by supplying low-temperature refrigerant flowing downstream of an outdoor electronic expansion valve (18) to the compressors (15, 22) when the superheating degree of the discharged refrigerant is larger than a first predetermined temperature.

13 Claims, 3 Drawing Sheets

REFRIGERATOR AND METHOD OF FILLING IT WITH COOLANT

TECHNICAL FIELD

This invention relates to a refrigerating apparatus and a method of charging refrigerant into the apparatus, and particularly relates to an improved technique of charging various kinds of refrigerants such as non-azeotropic mixed refrigerant.

BACKGROUND ART

In conventional refrigerating apparatuses using single refrigerant such as R22, the charging of refrigerant into refrigerant circuitry is executed in the following manner, as disclosed in "Shinban Dai-4-Han, Reito-Kucho Binran (Kiso-Hen)", pp.704–705, edited by Japan Society of Refrigerating and Air Conditioning Engineering.

Specifically, first, a refrigerant cylinder is connected through a tube to a refrigerant charge valve of the refrigerant circuitry previously maintained under vacuum. Then, the refrigerant charge valve is opened to let refrigerant in the refrigerant cylinder flow into the refrigerant circuitry due to the pressure difference between the insides of the refrigerant cylinder and the refrigerant circuitry.

As the refrigerant is charged into the refrigerant circuitry, the pressure in the refrigerant circuitry is increased. Therefore, the pressure difference between the insides of the refrigerant cylinder and the refrigerant circuitry becomes gradually lessened so that the charging speed of refrigerant is gradually reduced. In particular, when the air temperature at the outdoors where the refrigerant cylinder is put, i.e., the open-air temperature, is low, the pressure in the refrigerant cylinder is low and therefore the pressure difference readily becomes lessened.

Accordingly, the amount of refrigerant charged into the refrigerant circuitry per unit time is decreased. As a result, the charging speed of refrigerant becomes extremely slow in a short time. In other words, even though the pressure in the refrigerant cylinder is higher than that in the refrigerant circuitry, there arises a condition that substantially little refrigerant can be charged into the refrigerant circuitry.

If such a condition arises, the following measures are generally taken in order to increase the charging speed of refrigerant.

Specifically, the refrigerant cylinder is connected to a valve provided in the line on the suction side of a compressor. And, refrigerant is supplied to the refrigerant circuitry through the valve with the compressor operated. In this manner, a large pressure difference is ensured between the insides of the refrigerant circuitry and the refrigerant cylinder, thereby increasing the charging speed of refrigerant.

PROBLEMS TO BE SOLVED

In the case where refrigerant is charged into the line on the suction side of the compressor, however, the following problems arise.

A first problem is that when refrigerant is charged in its liquid state from the refrigerant cylinder, liquid refrigerant is sucked into the compressor, resulting in the possibility of breakage of the compressor due to liquid compression.

Another problem is that when refrigerant is charged in its gas state from the refrigerant cylinder and the refrigerant is non-azeotropic mixed refrigerant, the ratio of composition of the mixed refrigerant in a state of existing in the refrigerant cylinder becomes different from that of the mixed refrigerant in a state of having been charged into the refrigerant circuitry.

Specifically, in recent years, non-azeotropic mixed refrigerant such as R407C has come into increasing use as alternative refrigerant in view of global-scale environmental problems. The non-azeotropic mixed refrigerant has a characteristic that the ratio of composition in its gas state is different from that in its liquid state due to different boiling points of respective refrigerants forming the mixed refrigerant. In general, the non-azeotropic mixed refrigerant is adjusted in its ratio of composition when it is in a liquid state, and is then stored in the refrigerant cylinder as it is in a liquid state. Therefore, in the above-mentioned case where the mixed refrigerant has been charged in its gas state into the refrigerant circuitry, there arises a problem that the ratio of composition of the mixed refrigerant is changed. To be more specific, when the mixed refrigerant is charged in its gas state into the refrigerant circuitry, the ratio of composition of the mixed refrigerant in a state of having been charged into the refrigerant circuitry becomes different from that of the mixed refrigerant in a state of existing in the refrigerant cylinder, and therefore the mixed refrigerant has different properties between both the states. Accordingly, if the mixed refrigerant is charged in gas refrigerant form into the refrigerant circuitry, it cannot exhibit performance as designed. This extremely deteriorates performance of the refrigerating apparatus.

Consequently, for the non-azeotropic mixed refrigerant, it is impossible to adopt the method of charging it in a gas state into the refrigerant circuitry from the line on the suction side of the compressor in operation. Therefore, the mixed refrigerant must be charged with the compressor coming to a halt, which requires much time to complete the charging of refrigerant into the refrigerant circuitry.

Under such circumstances, there has been demand for charging refrigerant, particularly non-azeotropic mixed refrigerant, in a liquid state into the refrigerant circuitry without impairing reliability of the compressor.

The present invention has been made in view of the above problems, and therefore it is an object of the present invention is to attain prompt charging of refrigerant into the refrigerant circuitry without impairing reliability of the compressor.

DISCLOSURE OF INVENTION

Summary of Invention

To attain the above object, in the present invention, a refrigerant charging section (40A) is provided in part of refrigerant circuitry located far from a compressor (15, 22) and is held at low pressure by closing the upstream side of the refrigerant charging section (40A) while driving the compressor (15, 22), and new refrigerant is charged in its liquid state from the refrigerant charging section (40A) while high-pressure refrigerant is being released to the low-pressure-side line to prevent an excessive pressure rise in the high-pressure-side line and an excessive pressure drop in the low-pressure-side line.

Means for Solving the Problems

Specifically, a refrigerating apparatus of the present invention includes refrigerant circuitry (11) in which a compressor (15, 22), a heat-source-side heat exchanger (17), a pressure reduction mechanism (18), and a heat-use-side heat exchanger (20) are sequentially connected. Further, the refrigerant circuitry (11) includes: shutoff means (23) provided between the heat-source-side heat exchanger (17) and the heat-use-side heat exchanger (20); a refrigerant charging section (40A) provided downstream of the shutoff means (23) and brought into communication with a refrigerant source (31) when refrigerant is charged into the refrigerant circuitry (11); and a pressure relieving circuit (SVP) for conducting refrigerant in a high-pressure-side line of the refrigerant circuitry (11) to a low-pressure-side line thereof when the refrigerant is charged into the refrigerant circuitry (11) with the compressor (15, 22) driven.

The pressure relieving circuit may be formed of a refrigerant passage (SVP) for providing communication between the high-pressure-side and low-pressure-side lines of the refrigerant circuitry (11), and may be provided with auxiliary shutoff means (25) that is opened during the charging of refrigerant.

The pressure relieving circuit (SVP) may include a first circuit (SVP1) for conducting refrigerant in a line on the discharge side of the compressor (15, 22) to a line on the suction side thereof.

The pressure relieving circuit (SVP) may include a second circuit (SVP2) for conducting refrigerant in a line downstream of the heat-source-side heat exchanger (17) to a line on the suction side of the compressor (15, 22).

The shutoff means (23) may be provided between the heat-source-side heat exchanger (17) and the heat-use-side heat exchanger (20), and the pressure relieving circuit (SVP) may include a first circuit (SVP1) for conducting refrigerant in a line on the discharge side of the compressor (15, 22) to a line on the suction side thereof and a second circuit (SVP2) for conducting refrigerant in a line downstream of the heat-source-side heat exchanger (17) to the line on the suction side of the compressor (15, 22).

A liquid receiver (19) may be provided between the heat-source-side heat exchanger (17) and the shutoff means (23), and the upstream end (13c) of the second circuit (SVP2) of the pressure relieving circuit (SVP) may be connected to the liquid receiver (19).

The shutoff means (23) may be provided between the heat-source-side heat exchanger (17) and the heat-use-side heat exchanger (20), and the refrigerant circuitry (11) may be provided with an injection circuit (SVT) for supplying refrigerant condensed in the heat-source-side heat exchanger (17) to the compressor (15, 22) when refrigerant is charged into the refrigerant circuitry (11).

The injection circuit (SVT) may be provided with auxiliary shutoff means (27, 28), and the refrigerating apparatus may further include open/closed-position control means (53) for setting the auxiliary shutoff means (27, 28) in an open position when the superheating degree of refrigerant discharged from the compressor (15, 22) is larger than a first predetermined value, and setting the auxiliary shutoff means (27, 28) in a closed position when the superheating degree thereof is smaller than a second predetermined value equal to or below the first predetermined value.

Refrigerant charged into the refrigerant circuitry (11) may be non-azeotropic mixed refrigerant.

A refrigerant charging method of the present invention is for charging refrigerant into a refrigerant circuitry (11) in which a compressor (15, 22), a heat-source-side heat exchanger (17), a pressure reduction mechanism (18) and a heat-use-side heat exchanger (20) are sequentially connected, and comprises the steps of: blocking a refrigerant passage between the heat-source-side heat exchanger (17) and the heat-use-side heat exchanger (20) with the compressor (15, 22) operated thereby creating a low-pressure region (40A) downstream of the blocking part (23) of the refrigerant passage; releasing high-pressure refrigerant from a line on the discharge side of the compressor (15, 22) or a line upstream of the blocking part (23) to a line on the suction side of the compressor (15, 22); and connecting a refrigerant source (31) to the low-pressure region (40A) to allow liquid refrigerant in the refrigerant source (31) to flow in a liquid state into the low-pressure region (40A).

Operation

As described above, in charging refrigerant, the compressor (15, 22) is operated with the shutoff means (23) closed, so that the pressure in the refrigerant charging section (40A) is reduced. As a result, the pressure difference between the insides of the refrigerant source (31) and the refrigerant charging section (40A) is increased so that refrigerant in the refrigerant source (31) promptly flows into the refrigerant charging section (40A). The refrigerant charging section (40A) is provided upstream of the heat-use-side heat exchanger (20), and therefore it is located at a position of the refrigerant circuitry far from the compressor (15, 22). Accordingly, even if the refrigerant is caused to flow in a liquid state into the refrigerant charging section (40A), it can be avoided that liquid refrigerant is sucked directly into the compressor (15, 22). This increases reliability of the compressor (15, 22). In addition, the flowing of the refrigerant in a liquid state leads to prompt charging of refrigerant. The closing of the shutoff means (23) results in a pressure rise in the high-pressure-side line and a pressure drop in the low-pressure-side line of the refrigerant circuitry (11). However, since the refrigerant in the high-pressure side line of the refrigerant circuitry (11) is caused to flow into the low-pressure-side line thereof through the pressure relieving circuit (SVP), an excessive pressure rise in the high-pressure-side line and an excessive pressure drop in the low-pressure-side line can be prevented. This avoids unnecessary operations of a protective device such as a pressure switch and increases reliabilities of components of the refrigerant circuitry (11).

In charging refrigerant, the auxiliary shutoff means (25) is opened so that refrigerant in the high-pressure-side line is caused to flow into the low-pressure-side line through the refrigerant passage (SVP). Accordingly, an excessive pressure rise in the high-pressure-side line and an excessive pressure drop in the low-pressure-side line can be prevented by a simple arrangement.

In charging refrigerant, high-pressure refrigerant in the line on the discharge side of the compressor (15, 22) is supplied to the line on the suction side of the compressor (15, 22) through the first circuit (SVP1). This prevents an excessive pressure rise in the high-pressure-side line and an excessive pressure drop in the low-pressure-side line.

In charging refrigerant, refrigerant at slightly high pressure in the line downstream of the heat-source-side heat exchanger (17) is supplied to the line on the suction side of the compressor (15, 22) through the second circuit (SVP2). This prevents an excessive pressure rise in the high-pressure-side line and an excessive pressure drop in the low-pressure-side line.

In charging refrigerant, high-pressure refrigerant in the line on the discharge side of the compressor (15, 22) is supplied to the line on the suction side thereof through the first circuit (SVP1), and refrigerant at slightly high pressure in the line downstream of the heat-source-side heat exchanger (17) is supplied to the suction side of the compressor (15, 22) through the second circuit (SVP2).

In charging refrigerant, refrigerant in the line downstream of the heat-source-side heat exchanger (17) flows into the liquid receiver (19) and is then supplied to the low-pressure-side line through the second circuitry (SVP2) of the pressure relieving circuit (SVP).

In charging refrigerant, refrigerant reduced to a low temperature through the condensation in the heat-source-side heat exchanger (17) is supplied to the compressor (15, 22) through the injection circuit (SVT). Therefore, refrigerant discharged from the compressor (15, 22) is lowered in temperature, which prevents an excessive rise in temperature of the discharged refrigerant. This prevents the compressor (15, 22) and other components from being superheated, thereby increasing reliability of the refrigerating apparatus.

When the temperature of the discharged refrigerant becomes excessively high, the superheating degree of the refrigerant is larger than the first predetermined value. In this case, the auxiliary shutoff means (27, 28) is set in an open position so that low-temperature refrigerant is supplied to the compressor (15,22), resulting in decrease intemperature of the discharged refrigerant. On the other hand, when the temperature of the discharged refrigerant becomes excessively low, the superheating degree of the refrigerant is smaller than the second predetermined value. In this case, the auxiliary shutoff means (27, 28) is set in a closed position, resulting in decrease in temperature of the discharged refrigerant.

The non-azeotropic mixed refrigerant has a characteristic of having different ratios of composition between its liquid and gas states. However, by charging the mixed refrigerant into the refrigerant circuitry (11) while in a liquid state, change in ratio of composition of the mixed refrigerant due to the charging thereof in a gas state can be prevented. Accordingly, the refrigerating apparatus can exhibit its performance as designed.

When the refrigerant passage between the heat-source-side heat exchanger (17) and the heat-use-side heat exchanger (20) is blocked, the low-pressure region (40A) generates downstream of the blocking part (23). The refrigerant source (31) is connected to the low-pressure region (40A). By the pressure difference between the insides of the refrigerant source (31) and the low-pressure region (40A), refrigerant in the refrigerant source (31) flows into the refrigerant circuitry (11) from the low-pressure region (40A). The blocking of the refrigerant passage invites a pressure rise in the high-pressure-side line and a pressure drop in the low-pressure-side line of the refrigerant circuitry (11). However, since high pressure is released from the line on the discharge side of the compressor (15, 22) or the line upstream of the blocking part (23) to the line on the suction side of the compressor (15, 22), an excessive pressure rise in the high-pressure-side line and an excessive pressure drop in the low-pressure-side line can be prevented. This avoids unnecessary operations of a protective device such as a pressure switch and increases reliabilities of components forming the refrigerant circuitry (11).

Effects

According to the present invention, the pressure difference between the insides of the refrigerant source and the refrigerant charging section can be increased by closing the shutoff means. This enables prompt charging of refrigerant into the refrigerant circuitry. Further, since the refrigerant charging section is provided upstream of the heat-use-side heat exchanger, it can be avoided that liquid refrigerant is sucked directly into the compressor even if refrigerant is caused to flow in a liquid state into the refrigerant circuitry. This enables the charging of refrigerant in a liquid state without impairing reliability of the compressor. Furthermore, since refrigerant in the high-pressure-side line of the refrigerant circuitry is caused to flow into the low-pressure-side line thereof through the pressure relieving circuit, an excessive pressure rise in the high-pressure-side line and an excessive pressure drop in the low-pressure-side line can be prevented. This avoids unnecessary operations of a protective device and prevents deterioration in reliabilities of components of the refrigerant circuitry.

An excessive pressure rise in the high-pressure-side line and an excessive pressure drop in the low-pressure-side line can be prevented by simple and specific arrangements.

Since low-temperature refrigerant is supplied to the compressor through the injection circuit, an excessive rise in temperature of the discharged refrigerant can be prevented. This increases reliabilities of components such as the compressor.

Since the superheating degree of the discharged refrigerant can be controlled within a proper range of values, this allows the temperature of the discharged refrigerant to be maintained at a proper value according to operating conditions, thereby increasing reliability of the refrigerating apparatus.

Since it is possible to charge non-azeotropic mixed refrigerant into the refrigerant circuitry without changing its ratio of composition, the effect of charging refrigerant in a liquid state can be exerted more noticeably.

BEST MODE FOR CARRYING OUT THE INVENTION

Embodiments of the present invention will be described below with reference to the drawings.

Structure of Air Conditioner (10)

Figure 1:
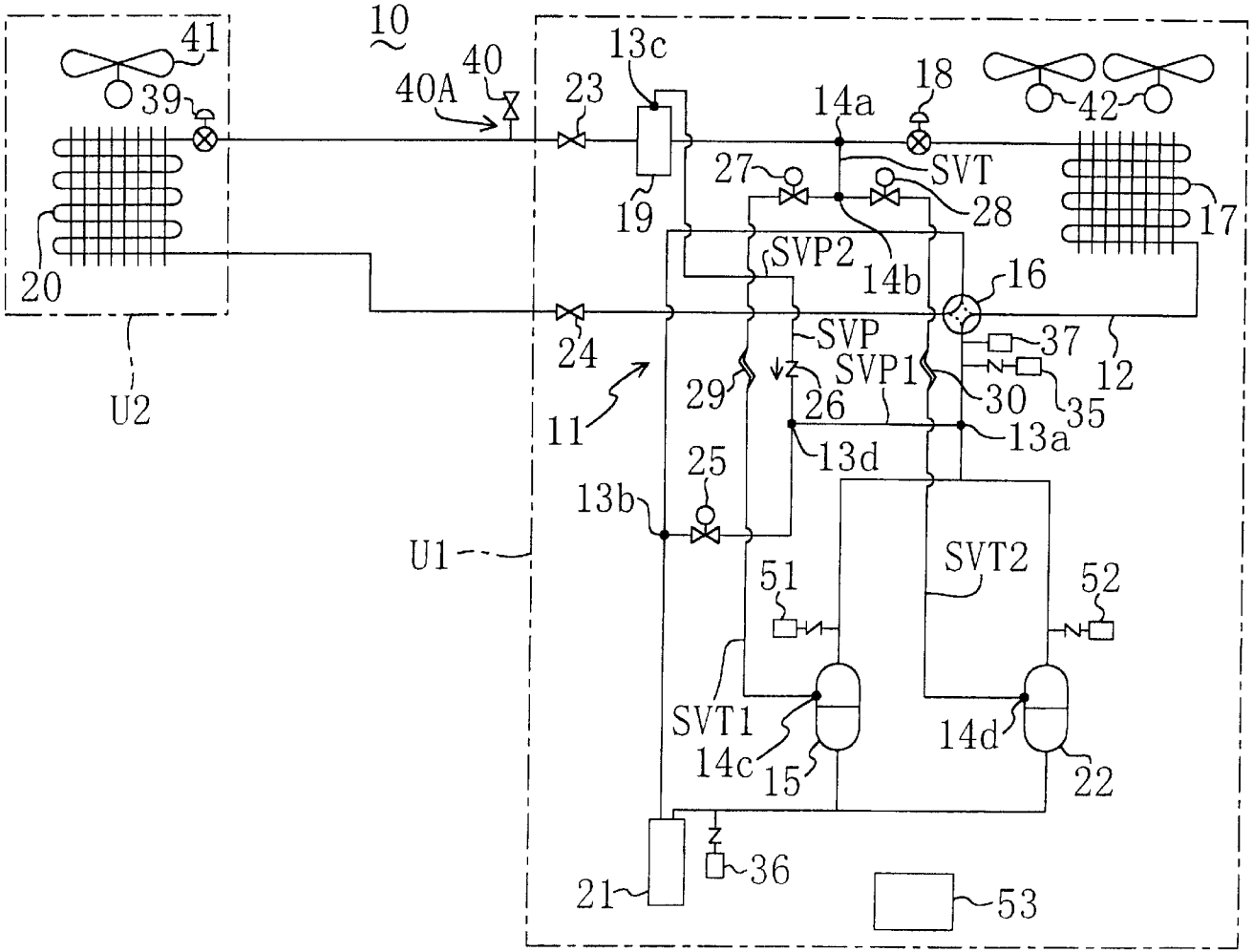
FIG. 1 is a refrigerant circuit diagram of an air conditioner.

As shown in FIG. 1, a refrigerating apparatus of the present embodiment is an air conditioner (10) including refrigerant circuitry (11) in which non-azeotropic mixed refrigerant circulates, and is formed of an outdoor unit (U1) and an indoor unit (U2) which are connected to each other.

The refrigerant circuitry (11) includes a main circuit (12), a pressure relieving circuit (SVP) and an injection circuit (SVT).

The main circuit (12) is a circuit for making refrigerant increased in pressure, making it condensed, making it reduced in pressure and making it evaporated. The main circuit (12) is formed such that a capacity-fixed first compressor (15) and a capacity-variable second compressor (22) arranged in parallel, a four-way selector valve (16), an outdoor heat exchanger (17) as a heat-source-side heat exchanger, an outdoor electronic expansion valve (18) as a pressure reduction mechanism, a liquid receiver (19), an indoor electronic expansion valve (39) as a pressure reduction mechanism, an indoor heat exchanger (20) as a heat-use-side heat exchanger, the above four-way selector valve (16) and an accumulator (21) are connected in this order. Between the liquid receiver (19) and the indoor electronic expansion valve (39), a liquid-side shutoff valve (23) as a shutoff means is provided. Between the indoor heat exchanger (20) and the four-way selector valve (16), a gas-side shutoff valve (24) is provided. Between the liquid-side shutoff valve (23) and the indoor electronic expansion valve (39), a refrigerant charging section (40A) equipped with a refrigerant charge valve (40) is provided. The refrigerant charging section (40A) turns to a low-pressure region by driving the compressors (15, 22) with the liquid-side shutoff valve (23) closed.

The pressure relieving circuit (SVP) is a circuit for preventing an excessive pressure rise in a high-pressure-side line and an excessive pressure drop in a low-pressure-side line of the main circuit when the liquid-side shutoff valve (23) is closed. And, the pressure relieving circuit (SVP) is formed of a first circuit (SVP1) and a second circuit (SVP2). The upstream end (13*a*) of the first circuit (SVP1) is connected to part of the refrigerant circuitry (11) located between the discharge sides of the compressors (15, 22) and the four-way selector valve (16), while the downstream end (13*b*) thereof is connected to part of the refrigerant circuitry (11) located between the four-way selector valve (16) and the accumulator (21). The first circuit (SVP1) is provided with a solenoid valve (25) as an auxiliary shutoff means. The upstream end (13*c*) of the second circuit (SVP2) is connected to the liquid receiver (19), while the downstream end (13*d*) thereof is connected to part of the first circuit (SVP1) located between the upstream end (13*a*) of the first circuit (SVP1) and the solenoid valve (25). The second circuit (SVP2) is provided with a check valve (26) allowing a unidirectional flow of refrigerant from the upstream end (13*c*) to the downstream end (13*d*) thereof.

The injection circuit (SVT) is a circuit for injecting low-temperature refrigerant into the compressors (15, 22) to lower the temperature of refrigerant discharged from the compressors (15, 22) when the temperature of the discharged refrigerant has become excessively high. The injection circuit (SVT) is provided with a first injection circuit (SVT1) and a second injection circuit (SVT2). The respective downstream ends (14*c*, 14*d*) of the first and second injection circuits (SVT1, SVT2) are connected to the first and second compressors (15, 22), respectively. Upstream parts of both the injection circuits (SVT1, SVT2) join into one at a confluent end (14*b*), and the part of the injection circuit (SVT) upstream of the onfluent end (14*b*) is connected to part of the main circuit (12) located between the outdoor electronic expansion valve (18) and the liquid receiver (19) thereby forming an upstream end (14*a*). In other words, the upstream end (14*a*) of the injection circuit (SVT) is provided at the part through which low-temperature refrigerant flows. The first injection circuit (SVT1) includes a first solenoid valve (27) and a first capillary tube (29) provided therein sequentially from the confluent end (14*b*) toward the downstream end (14*c*) thereof. Likewise, the second injection circuit (SVT2) includes a second solenoid valve (28) and a second capillary tube (30) provided therein sequentially from the confluent end (14*b*) toward the downstream end (14*d*) thereof.

The indoor heat exchanger (20) and an indoor fan (41) are housed in the indoor unit (U2). On the other hand, other components of the main circuit (12), the pressure relieving circuit (SVP), the injection circuit (SVT) and an outdoor fan (42) are housed in the outdoor unit (U1).

The outdoor electronic expansion valve (18) is set in a full-open position during cooling operation of the air conditioner, is adjusted in opening to maintain the superheating degree of refrigerant at a predetermined value during heating operation of the air conditioner, and is set in principle in a full-open position during operation of charging refrigerant. The indoor electronic expansion valve (39) is adjusted in opening to maintain the superheating degree of refrigerant at a predetermined value during the cooling operation, is adjusted in opening to maintain the subcooling degree of refrigerant at a predetermined value during the heating operation, and is set in a full-open position during the operation of charging refrigerant.

In a line of the refrigerant circuitry (11) located on the discharge sides of the compressors (15, 22), a high-pressure sensor (35) as a pressure sensor for detecting the pressure on the high-pressure side of the refrigerant circuitry (11) and a discharge-temperature sensor (37) as a temperature sensor for detecting the temperature of discharged refrigerant are provided. In a line of the refrigerant circuitry (11) located on the suction sides of the compressors (15, 22), a low-pressure sensor (36) as a pressure sensor for detecting the pressure on the low-pressure side of the refrigerant circuitry (11) is provided.

The high-pressure sensor (35), the low-pressure sensor (36), the discharge temperature sensor (37), the solenoid valve (25) of the pressure relieving circuit (SVP), and the first and second solenoid valves (27, 28) of the injection circuit (SVT) are connected to a controller (53) through unshown signal lines. The controller (53) stores a program as described later for operation of additionally charging refrigerant and is configured to execute such operation.

In respective discharge lines of the first and second compressors (15, 22), respective high-pressure-sensitive pressure switches (51, 52) as protective switches are provided.

Method of Charging Refrigerant into Air Conditioner (10)

Figure 2:
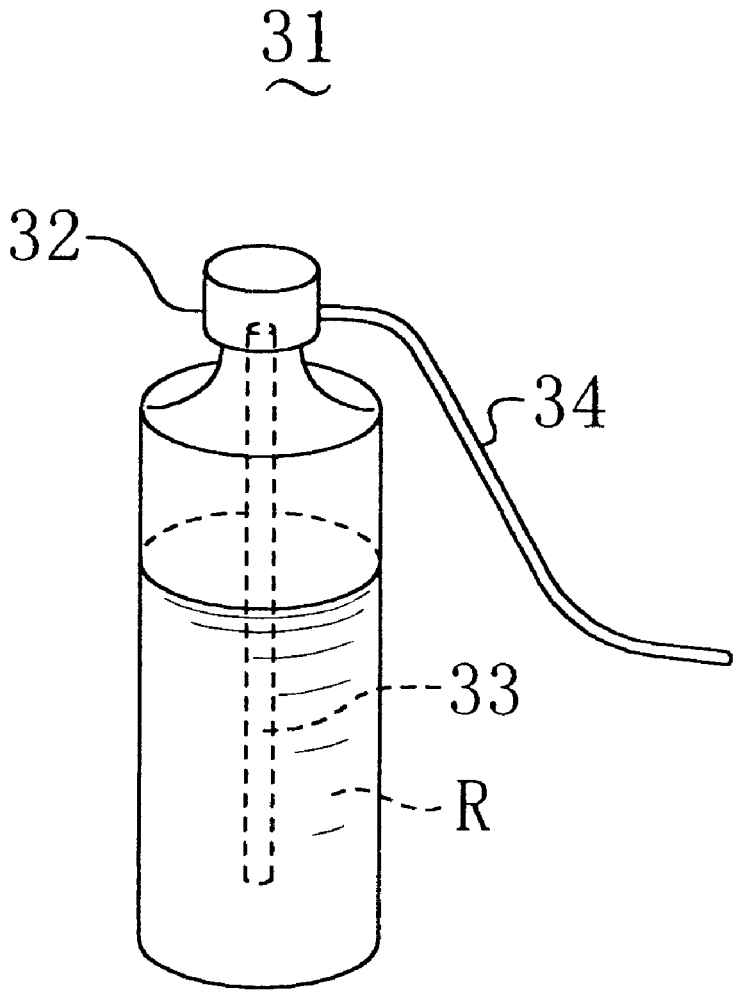
FIG. 2 is a perspective view showing a siphon type cylinder.

A description will be made about a method of charging refrigerant into the refrigerant circuitry (11) of the air conditioner (10). Refrigerant to be charged into the refrigerant circuitry (11) is non-azeotropic mixed refrigerant (for example, R407C). The non-azeotropic mixed refrigerant is previously adjusted in its ratio of composition and is then stored in a siphon type cylinder (31) as shown in FIG. 2. The siphon type cylinder (31) is a cylinder for supplying liquid refrigerant in its standing position, wherein a straw-shaped hollow tube (33) connected to a base valve (32) thereof extends to liquid refrigerant (R) existing in the bottom of the cylinder such that the liquid refrigerant is discharged through the hollow tube (33). It is tobe noted that the cylinder (31) serves as a refrigerant source according to the present invention.

Prior to the charging of refrigerant into the refrigerant circuitry (11), the refrigerant circuitry (11) is previously put under vacuum through the suction of air.

Figure 3:
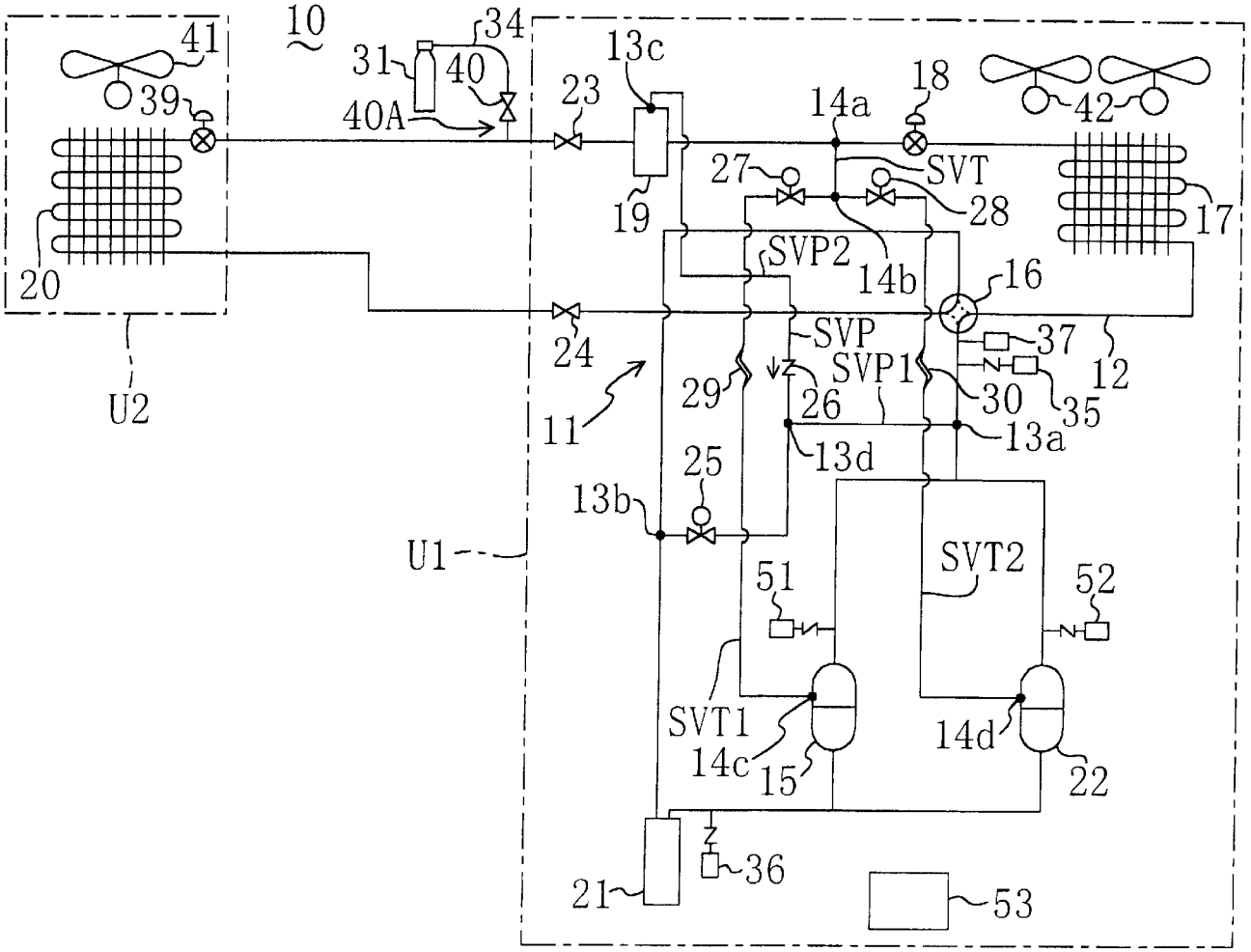
FIG. 3 is a refrigerant circuit diagram of the air conditioner during the charging of refrigerant.

Next, as shown in FIG. 3, the cylinder (31) is connected to the refrigerant charge valve (40) of the refrigerant circuitry (11) through a refrigerant hose (34) with care taken not to let air get inside the refrigerant circuitry (11). Then, both the base valve (32) of the cylinder (31) and the refrigerant charge valve (40) are opened. As a result, a pressure difference between the insides of the cylinder (31) and the refrigerant circuitry (11) causes the refrigerant in the cylinder (31) to flow into the refrigerant circuitry (11)

through the refrigerant charge valve (40). In this manner, for the execution of initial charging, a certain amount of refrigerant is charged into the refrigerant circuitry (11) until the pressure difference becomes small.

Thereafter, when the pressure difference becomes small so that the charging speed of refrigerant becomes slow, additional refrigerant charging operation is executed in the following manner.

<Additional Refrigerant Charging Operation>

When the operation mode of the air conditioner (10) is set in additional refrigerant charging operation, the controller (53) closes the liquid-side shutoff valve (23), opens the solenoid valve (25) of the pressure relieving circuit (SVP), and closes both the first and second solenoid valves (27, 28) of the injection circuit (SVT). The outdoor electronic expansion valve (18) is set in a full-open position or at a predetermined opening. In these conditions, the second compressor (22) is started up and the indoor and outdoor fans (41, 42) are activated.

Since the second compressor (22) is driven with the liquid-side shutoff valve (23) closed in the above manner, a low-pressure region is formed in a section of the refrigerant circuitry which runs from the liquid-side shutoff valve (23) toward the indoor heat exchanger (20), namely, in the section downstream of the liquid-side shutoff valve (23), due to suction toward the suction side of the second compressor (22) applied to the section. In other words, the liquid-side shutoff valve (23) serves as a blocking part of the refrigerant circuitry and the refrigerant charging section (40A) becomes a low-pressure region. Therefore, the pressure difference between the cylinder (31) and the refrigerant charging section (40A) becomes large so that the refrigerant in the cylinder (31) promptly flows into the refrigerant circuitry (11) through the refrigerant charging section (40A). Because a large pressure difference is ensured between the cylinder (31) and the refrigerant charging section (40A) at any time, the charging of refrigerant can promptly be completed.

Part of high-pressure refrigerant discharged from the second compressor (22) is bypassed to flow into the pressure relieving circuit (SVP) from the upstream end (13*a*) and flow into the low-pressure-side line of the refrigerant circuitry (11) from the downstream end (13*b*). On the other hand, the other part of high-pressure refrigerant discharged from the second compressor (22) flows through the four-way selector valve (16) and the outdoor heat exchanger (17), flows into the liquid receiver (19), and is bypassed to flow into the pressure relieving circuit (SVP) from the upstream end (13*c*), merge with the part of refrigerant flowing from the upstream end (13*a*) and flow into the low-pressure-side line of the refrigerant circuitry (11) from the downstream end (13*b*).

Accordingly, in spite of the closing of the liquid-side shutoff valve (23), an excessive pressure rise in the high-pressure-side line and an excessive pressure drop in the low-pressure-side line of the refrigerant circuitry can be prevented.

Since the refrigerant charging section (40A) is at low pressure, part of liquid refrigerant flowing into the refrigerant circuitry (11) from the cylinder (31) evaporates when flowing thereinto. The other part of the liquid refrigerant evaporates in the indoor heat exchanger (20). The refrigerant evaporated into a gas state passes through the four-way selector valve (16) and the accumulator (21) and is then sucked into the second compressor (22). Therefore, it can be avoided that liquid refrigerant is sucked into the second compressor (22). Accordingly, failure due to liquid compression or the like seldom occurs in the compressor.

In the above operation, though an excessive pressure rise in the high-pressure-side line is prevented, there may occur the case where the temperature of refrigerant discharged from the compressor becomes excessively high because of the closing of the liquid-side shutoff valve (23). Therefore, when the temperature of the discharged refrigerant becomes excessively high, the air conditioner (10) of this embodiment is adapted, for protection of the compressors (15, 22) and other components, to lower the temperature of the discharged refrigerant by supplying low-temperature refrigerant to the compressors (15, 22) through the injection circuit (SVT).

Specifically, when the superheating degree of the discharged refrigerant, calculated from values detected by the high-pressure sensor (35) and the discharge temperature sensor (37), is larger than a first predetermined temperature, the controller (53) opens the second solenoid valve (28). As a result, refrigerant in part of the main circuit (12) located downstream of the outdoor electronic expansion valve (18) flows into the injection circuit (SVT) from its upstream end (14*a*), and then flows into the second compressor (22) through the second solenoid valve (28) and the second capillary tube (30). Accordingly, the temperature of refrigerant discharged from the second compressor (22) is decreased. On the other hand, when the superheating degree of the discharged refrigerant is smaller than a second predetermined temperature, the controller (53) closes the second solenoid valve (28). As a result, the flowing of low-pressure refrigerant into the second compressor (22) is prevented so that the decrease in temperature of the discharged refrigerant is suppressed. It is to be noted that the second predetermined temperature is equal to or below the first predetermined temperature. Particularly in this embodiment, in order to avoid frequent openings and closings of the second solenoid valve (28), the second predetermined temperature is set at a value less than the first predetermined temperature by providing a differential between the first and second predetermined temperatures.

The additional refrigerant charging operation as described above is executed until a predetermined amount of refrigerant is charged into the refrigerant circuitry (11). In other words, the additional refrigerant charging operation is completed at the time when the predetermined amount of refrigerant has been charged.

Whether or not the predetermined amount of refrigerant has been charged is determined, for example, in the following manner. The cylinder (31) is put on a weightometer (not shown) and the weight (initial weight) of the cylinder (31) before charging refrigerant into the refrigerant circuitry is previously measured. When the cylinder (31) starts charging the refrigerant, the refrigerant therein gradually flows into the refrigerant circuitry (11) and the weight (current weight) of the cylinder (31) is correspondingly decreased by degrees. Then, when the value obtained by subtracting the current weight from the initial weight of the cylinder (31) reaches a predetermined charge amount of refrigerant, it is determined that the predetermined amount of refrigerant has been charged into the refrigerant circuitry (11).

Thereafter, the refrigerant charge valve (40) is closed and the refrigerant hose (34) is removed. Thus, the charging of refrigerant is completed.

In the above additional refrigerant charging operation, only the second compressor (22) has been operated. However, needless to say, both the first and second compressors (15, 22) may be operated in the additional refrigerant charging operation. In this case, both the first and second injection circuits (SVT1, SVT2) are operated concurrently.

Effects of Refrigerant Charging Method and Air Conditioner (10)

In the air conditioner (10) described above, by closing the liquid-side shutoff valve (23) with the compressors (15, 22) operated, the refrigerant charging section (40A) is maintained at low pressure. As a result, the pressure difference between the insides of the cylinder (31) and the refrigerant charging section (40A) can be held large. This enables the refrigerant in the cylinder (31) to be promptly charged into the refrigerant circuitry (11).

At the time, refrigerant in the high-pressure-side line of the refrigerant circuitry (11) is released to the low-pressure-side line thereof through the pressure relieving circuit (SVP). Accordingly, an excessive pressure rise in the high-pressure-side line and an excessive pressure drop in the low-pressure-side line of the refrigerant circuitry (11) can be prevented. This obviates unnecessary operations of a protective device. In addition, components of the refrigerant circuitry (11) can be prevented from impairing their reliabilities. Conversely, since the air conditioner (10) includes the pressure relieving circuit (SVP), this makes it possible to operate the compressors (15, 22) with the liquid-side shutoff valve (23) closed.

In the case where the superheating degree of refrigerant discharged from the compressors (15, 22) is large, low-temperature refrigerant is supplied to the compressors (15, 22) through the injection circuit (SVT), which prevents an excessive rise in temperature of the discharged refrigerant. Accordingly, the compressors (15, 22) can surely be prevented from being overheated and thereby can be increased in reliability. Likewise, other circuit components can also be increased in reliability.

Furthermore, in the above air conditioner (10), the refrigerant charging section (40A) is provided upstream of the indoor heat exchanger (20). In other words, refrigerant is charged into the refrigerant circuitry not through the line on the suction sides of the compressors (15, 22) but through the line upstream of the indoor heat exchanger (20). Thus, since refrigerant is charged from part of the refrigerant circuitry far from the suction sides of the compressors (15, 22), this avoids liquid refrigerant from flowing directly into the compressors (15, 22) even if the refrigerant is charged in its liquid state into the refrigerant circuitry. This enables the charging of liquid refrigerant without impairing reliabilities of the compressors (15, 22).

Since it is thus possible to charge refrigerant in a liquid state into the refrigerant circuitry (11), the ratio of composition of the charged refrigerant does not change even if the charged refrigerant is non-azeotropic mixed refrigerant. Accordingly, since the refrigerant charged into the refrigerant circuitry (11) has properties as designed, the air conditioner (10) also can exhibit performance as designed.

In addition, since the refrigerant is charged in its liquid state, the charge amount of refrigerant per unit time is large. This enables prompt charging of refrigerant.

Since the program for the additional refrigerant charging operation is previously set in the controller (53), the charging of refrigerant can be executed with ease and reliability.

Other Embodiments

The additional refrigerant charging operation may be conducted in a plurality of stages such that the capacity of the compressors (15, 22) is gradually increased. For example, the additional refrigerant charging operation may be divided into a first stage to be executed immediately after the start-up of the compressors (15, 22) and a second stage to be subsequently executed, and the compressors (15, 22) may be operated at a small capacity in the first stage and at a larger capacity in the second stage. Correspondingly, in order to form the refrigerant charging section (40A) into a desirable low-pressure region, the outdoor electronic expansion valve (18) may be controlled to open by one-half of the maximum opening in the first stage and to open to the maximum opening in the second stage. Thereby, refrigerant can smoothly flow from the cylinder (31) into the refrigerant circuitry (11), which achieves further stable charging of refrigerant.

The present invention exerts noticeable effects particularly on non-azeotropic mixed refrigerant. However, refrigerant to be charged in the present invention is not limited to non-azeotropic mixed refrigerant, but it may be pseudo-azeotropic mixed refrigerant or single refrigerant.

It is to be noted that the refrigerating apparatus according to the present invention is not limited to a refrigerating apparatus in the narrow sense (apparatus for refrigerating substances). The apparatus according to the present invention is a refrigerating apparatus in such a broad sense as including a heat pump type air conditioner, a cooling apparatus, a heating apparatus and a refrigerator.

Industrial Applicability

As described so far, the present invention is useful for air conditioners, refrigerating machines, refrigerators and the like.

What is claimed is:

1. A refrigerating apparatus comprising refrigerant circuitry (11) in which a compressor (15, 22), a heat-source-side heat exchanger (17), a pressure reduction mechanism (18), and a heat-use-side heat exchanger (20) are sequentially connected, wherein the refrigerant circuitry (11) includes:

shutoff means (23) provided between the heat-source-side heat exchanger (17) and the heat-use-side heat exchanger (20);

a refrigerant charging section (40A) provided downstream of the shutoff means (23) and brought into communication with a refrigerant source (31) when refrigerant is charged into this refrigerant circuitry (11); and a pressure relieving circuit (SVP) for conducting refrigerant in a high-pressure-side line of the refrigerant circuitry (11) to a low-pressure-side line thereof when the refrigerant is charged into the refrigerant circuitry (11) with the compressor (15, 22) driven;

wherein the pressure relieving circuit is formed of a refrigerant passage (SVP) for providing communication between the high-pressure-side and low-pressure-side lines of the refrigerant circuitry (11), and is provided with auxiliary shutoff means (25) that is opened during the charged of refrigerant.

2. The refrigerating apparatus of claim 1, wherein refrigerant charged into the refrigerant circuitry (11) is non-azeotropic mixed refrigerant.

3. A refrigerating apparatus comprising refrigerant circuitry (11) in which a compressor (15, 22), a heat-source-side heat exchanger (17), a pressure reduction mechanism (18), and a heat-use-side heat exchanger (20) are sequentially connected, wherein the refrigerant circuitry (11) includes:

shutoff means (23) provided between the heat-source-side heat exchanger (17) and the heat-use-side heat exchanger (20);

a refrigerant charging section (40A) provided downstream of the shutoff means (23) and brought into communication with a refrigerant source (31) when refrigerant is charged into this refrigerant circuitry (11); and a pressure relieving circuit (SVP) for conducting refrigerant in a high-pressure-side line of the refrigerant circuitry (11) to a low-pressure-side line thereof when the refrigerant is charged into the refrigerant circuitry (11) with the compressor (15, 22) driven;

wherein the pressure relieving circuit (SVP) includes a first circuit (SVP1) for conducting refrigerant in a line on the discharge side of the compressor (15, 22) to a line on the suction side thereof.

4. The refrigerating apparatus of claim 3, wherein refrigerant charged into the refrigerant circuitry (11) is non-azeotropic mixed refrigerant.

5. A refrigerating apparatus comprising refrigerant circuitry (11) in which a compressor (15, 22), a heat-source-side heat exchanger (17), a pressure reduction mechanism (18), and a heat-use-side heat exchanger (20) are sequentially connected, wherein the refrigerant circuitry (11) includes:

shutoff means (23) provided between the heat-source-side heat exchanger (17) and the heat-use-side heat exchanger (20);

a refrigerant charging section (40A) provided downstream of the shutoff means (23) and brought into communication with a refrigerant source (31) when refrigerant is charged into this refrigerant circuitry (11); and a pressure relieving circuit (SVP) for conducting refrigerant in a high-pressure-side line of the refrigerant circuitry (11) to a low-pressure-side line thereof when the refrigerant is charged into the refrigerant circuitry (11) with the compressor (15, 22) driven;

wherein the pressure relieving circuit (SVP) includes a second circuit (SVP2) for conducting refrigerant in a line downstream of the heat-source-side heat exchanger (17) to a line on the suction side of the compressor (15, 22).

6. The refrigerating apparatus of claim 4 or 5, wherein a liquid receiver (19) is provided between the heat-source-side heat exchanger (17) and the shutoff means (23), and the upstream end (13*c*) of the second circuit (SVP2) of the pressure relieving circuit (SVP) is connected to the liquid receiver (19).

7. The refrigerating apparatus of claim 5, wherein refrigerant charged into the refrigerant circuitry (11) is non-azeotropic mixed refrigerant.

8. A refrigerating apparatus comprising refrigerant circuitry (11) in which a compressor (15, 22), a heat-source-side heat exchanger (17), a pressure reduction mechanism (18), and a heat-use side heat exchanger (20) are sequentially connected, wherein the refrigerant circuitry (11) includes:

shutoff means (23) provided between the heat-source-side heat exchanger (17) and the heat-use-side heat exchanger (20);

a refrigerant charging section (40A) provided downstream of the shutoff means (23) and brought into communication with a refrigerant source (31) when refrigerant is charged into this refrigerant circuitry (11); and a pressure relieving circuit (SVP) for conducting refrigerant in a high-pressure-side line of the refrigerant circuitry (11) to a low-pressure-side line thereof when the refrigerant is charged into the refrigerant circuitry (11) with the compressor (15, 22) driven;

wherein the shutoff means (23) is provided between the heat-source-side heat exchanger (17) and the heat-use-side heat exchanger (20), and the pressure relieving circuit (SVP) includes a first circuit (SVP1) for conducting refrigerant in a line on the discharge side of the compressor (15, 22) to a line on the suction side thereof and a second circuit (SVP2) for conducting refrigerant in a line downstream of the heat-source-side heat exchanger (17) to the line of the suction side of the compressor (15, 22).

9. The refrigerant apparatus of claim 8, wherein refrigerant charged into the refrigerant circuitry (11) is non-azeotropic mixed refrigerant.

10. A refrigerating apparatus comprising refrigerant circuitry (11) in which a compressor (15, 22), a heat-source-side heat exchanger (17), a pressure reduction mechanism (18), and a heat-use-side heat exchanger (20) are sequentially connected, wherein the refrigerant circuitry (11) includes:

shutoff means (23) provided between the heat-source-side heat exchanger (17) and the heat-use-side heat exchanger (20);

a refrigerant charging section (40A) provided downstream of the shutoff means (23) and brought into communication with a refrigerant source (31) when refrigerant is charged into this refrigerant circuitry (11); and a pressure relieving circuit (SVP) for conducting refrigerant in a high-pressure-side line of the refrigerant circuitry (11) to a low-pressure-side line thereof when the refrigerant is charged into the refrigerant circuitry (11) with the compressor (15, 22) driven;

wherein the shutoff means (23) is provided between the heat-source-side heat exchanger (17) and the heat-use-side heat exchanger (20), and the refrigerant circuitry (11) is provided with an injection circuit (SVT) for supplying refrigerant condensed in the heat-sources-side heat exchanger (17) to the compressor (15, 22) when refrigerant is charged into the refrigerant circuitry (11).

11. The refrigerating apparatus of claim 10, wherein the injection circuit (SVT) is provided with auxiliary shutoff means (27, 28), and the refrigerating apparatus further comprises open/closed-position control means (53) for setting the auxiliary shutoff means (27, 28) in an open position when the superheating degree of refrigerant discharged from the compressor (15, 22) is larger than a first predetermined value, and setting the auxiliary shutoff means (27, 28) in a closed position when the superheating degree thereof is smaller than a second predetermined value equal to or below the first predetermined value.

12. The refrigerant apparatus of claim 10, wherein refrigerant charged into the refrigerant circuitry (11) is non-azeotropic mixed refrigerant.

13. A refrigerant charging method for charging refrigerant into a refrigerant circuitry (11) in which a compressor (15, 22), a heat-source-side heat exchanger (17), a pressure reduction mechanism (18) and a heat-use-side heat exchanger (20) are sequentially connected, the method comprising the steps of:

blocking a refrigerant passage between the heat-source-side heat exchanger (17) and the heat-use-side heat exchanger (20) with the compressor (15, 22) operated, thereby creating a low-pressure region (40A) downstream of the blocking part (23) of the refrigerant passage;

releasing high-pressure refrigerant from a line on the discharge side of the compressor (15, 22) or a line upstream of the blocking part (23) to a line on the suction side of the compressor (15, 22); and connecting a refrigerant source (31) to the low-pressure region (40A) to allow liquid refrigerant in the refrigerant source (31) to flow in a liquid state into the low-pressure region (40A).

* * * * *